US005643003A

United States Patent [19]

Myer et al.

[11] Patent Number: 5,643,003

[45] Date of Patent: Jul. 1, 1997

[54] HOUSING LATCH WITH CONNECTOR POSITION ASSURANCE DEVICE

[75] Inventors: John Mark Myer, Millersville; John Raymond Shuey, Mechanicsburg, both of Pa.

[73] Assignee: The Whitaker Corporation, Wilmington, Del.

[21] Appl. No.: 458,605

[22] Filed: Jun. 2, 1995

[51] Int. Cl.[6] ..... H01R 13/627

[52] U.S. Cl. ..... 439/352; 439/489

[58] Field of Search ..... 439/489, 488, 439/350, 352

[56] References Cited

U.S. PATENT DOCUMENTS

| | | | |
|---|---|---|---|
| 4,370,013 | 1/1983 | Niitsu et al. | 339/82 |
| 4,634,204 | 1/1987 | Detter et al. | 339/91 R |
| 4,708,413 | 11/1987 | Schroeder | 439/358 |
| 4,711,511 | 12/1987 | Noorily | 439/347 |
| 4,746,306 | 5/1988 | Yurtin et al. | 439/357 |
| 4,946,404 | 8/1990 | Takenouchi et al. | 439/352 |
| 4,950,179 | 8/1990 | Takenouchi et al. | 439/352 |
| 4,993,967 | 2/1991 | Matsumoto | 439/489 |
| 5,026,298 | 6/1991 | Brussalis et al. | 439/358 |
| 5,066,244 | 11/1991 | Kato et al. | 439/489 |
| 5,120,255 | 6/1992 | Kouda et al. | 439/489 |
| 5,131,865 | 7/1992 | Taguchi et al. | 439/489 |
| 5,163,848 | 11/1992 | Maeda et al. | 439/489 |
| 5,234,356 | 8/1993 | Maejima et al. | 439/352 |

FOREIGN PATENT DOCUMENTS

| | | | |
|---|---|---|---|
| 4133336 | 4/1992 | Germany | H01R 13/62 |

*Primary Examiner*—P. Austin Bradley
*Assistant Examiner*—Yong Ki Kim
*Attorney, Agent, or Firm*—Timothy J. Aberle

[57] ABSTRACT

A connector assembly (10) includes a plug housing (20) with a housing latch (30) formed thereon that includes grooves (32) for slidably receiving a connector position assurance device (CPA) (40). The CPA (40) is inserted from a mating side face (25) of the housing (20) and is operable to assure that a further matable connector is fully mated to the housing (20). The CPA (40) includes a deflectable beam (41) and an embossment (44). The beam (41) will deflect below projections (34) of latch (30) as the CPA (40) is moved into its final position. When the CPA (40) is in its final position, the operator can readily observe that the housing (20) has been fully mated to the further matable connector.

67 Claims, 6 Drawing Sheets

HOUSING LATCH WITH CONNECTOR POSITION ASSURANCE DEVICE

The present invention relates to an electrical connector assembly which includes a connector position assurance (CPA) device for assuring that matable connector halves, i.e. a header and plug housing, have been fully mated to each other. More particularly, the present invention relates to a CPA which is assembled to a plug housing and is received within a housing latch thereof.

BACKGROUND OF THE INVENTION

A known CPA is disclosed in U.S. Pat. No. 4,634,204. This known connector device provides electrical terminals having matable male and female connector halves, one of which has a resilient, extended lock arm means that will lock behind a lock bar of a sized window of the complementary connector half. When the two connector halves are mated, a CPA and an assist device are inserted axially along a track slot. The CPA device includes releasable, resilient lock tab means to retain it in operative engagement with the connectors. This known CPA device provides a means of assuring that the male and female connectors have been fully mated. However, this known device is not readily adaptable to plug housings which include a deflectable latching arm that the operator deflects with his hand or finger. Moreover, once the CPA is fully advanced into its final position, the operator must use a tool to deflect a latching section of the CPA so that the connector halves can be separated.

Another known CPA device is disclosed in U.S. Pat. No. 5,131,865. This known connector has a coupling detecting function which includes an electrical circuit between coupling-detecting electrical contact elements. The connector includes a resilient locking arm, and a cooperable engaging element, which are provided on first and second housings, respectively. A short-circuiting contact element is secured to the engaging element. When the two housings are coupled together, the coupling-detecting contact elements are urged to electrically contact the shorting-circuiting element for the purpose of indicating an electrical connection, thereby indicating complete coupling of the mating halves. This known CPA provides a way of assuring that two matable connector halves have been fully mated; however, it requires an electrical circuit within the latching member so that complete coupling of the matable halves will be indicated by way of an electrical circuit. This solution is expensive, and requires specialized parts and tooling for the manufacture of the connector halves.

The present invention seeks to overcome the deficiencies of the prior connectors by providing a CPA which: is of a low manufacturing cost; is highly reliable in its function as a CPA; does not require electrical circuitry in order to perform its function; is insertable from a mating face of a plug housing so that the CPA will be in a first position when the housing members are connected; and is readily adaptable for use with housing latch mechanisms of various configurations. If the CPA becomes loosened during shipping or handling, the header of the present invention is operable to engage and push the loosened CPA to the first position prior to fully mating with the plug housing. This is an advantage for the operator regarding ease of assembly.

SUMMARY OF THE INVENTION

The present invention provides an electrical connector housing assembly which includes a connector position assurance device (CPA) and a connector housing with at least one contact receiving aperture therein which extends from a mating face of the housing. The assembly further includes a deflectable housing latch formed on the connector housing, the housing latch includes at least one groove formed in a deflectable beam thereof for slidably receiving a respective portion of the CPA. The CPA respective portion comprises a flange, the CPA flange is slidably movable in the groove between first and second positions relative to the housing latch, and the CPA includes a deflectable, resilient beam.

Whereby, a deflecting force which, when applied to the housing latch, causes the housing latch to deflect relative to the housing, will also cause the CPA to be displaced relative to the housing when the CPA is in the first position. Additionally, the plug housing assembly is adapted to be matably connected to a header having a tapered CPA flange therein which interfaces with the CPA in a way that deflects the CPA deflectable beam upon full mating of the plug housing with the header.

DETAILED DESCRIPTION OF THE INVENTION

Figure 1:
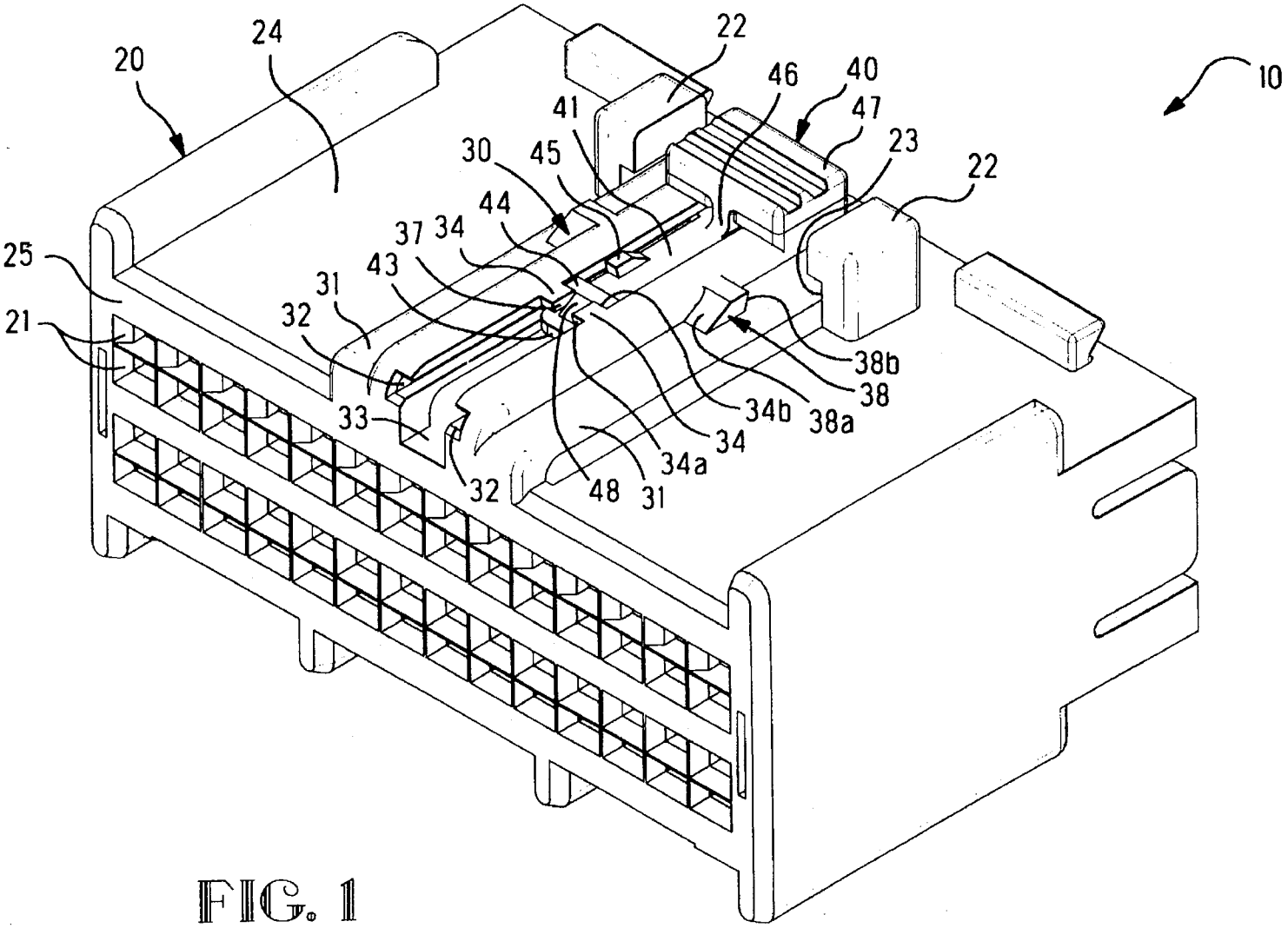
FIG. 1 shows an isometric view of the CPA according to the present invention when installed on a latching mechanism of a plug housing.

FIG. 1 shows a connector assembly 10, according to the present invention, which includes a housing 20 and a CPA 40. Housing 20 is made of a suitable engineering plastic and includes contact receiving apertures 21, latch posts 22 each having a respective post recess 23, an upper surface 24 from which the posts 22 extend, and a mating face 25 into which apertures 21 extend. Housing 20 further includes a housing latch mechanism 30 including deflectable beams 31, a CPA groove 32 formed in each respective beam 31, a void space 33 between the beams 31, stop projections 34 on the respective beams 31 with each stop projection including a ramp 34*a* and an undercut 34*b*, a gap disposed between stop projections 34, and latching shoulders 38 each including a ramp 38*a* and a flange surface 38*b*.

Figure 4:
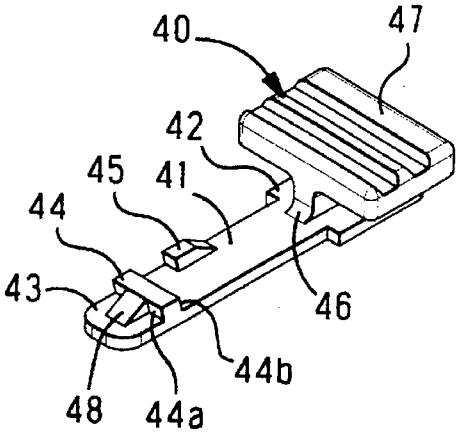
FIG. 4 shows an isometric view of the CPA of FIG. 1.

Referring to FIGS. 1 and 4, CPA 40 is made of a suitable engineering plastic and includes a deflectable beam 41, flanges 42 for being received by groove 32, an end section 43, an embossment 44, a stop member 45, a support section 46, an operating section 47, and an embossment support 48 for supporting embossment 44. Referring to FIG. 4, embossment 44 includes an undercut surface 44*a* and a ramp surface 44*b*. CPA 40, in FIG. 1, is shown in its first position relative to housing latch 30. It is contemplated that a stiffening rib can be formed on the bottom surface of beam 41 along all or substantially all of the length of the CPA 40.

Figure 2:
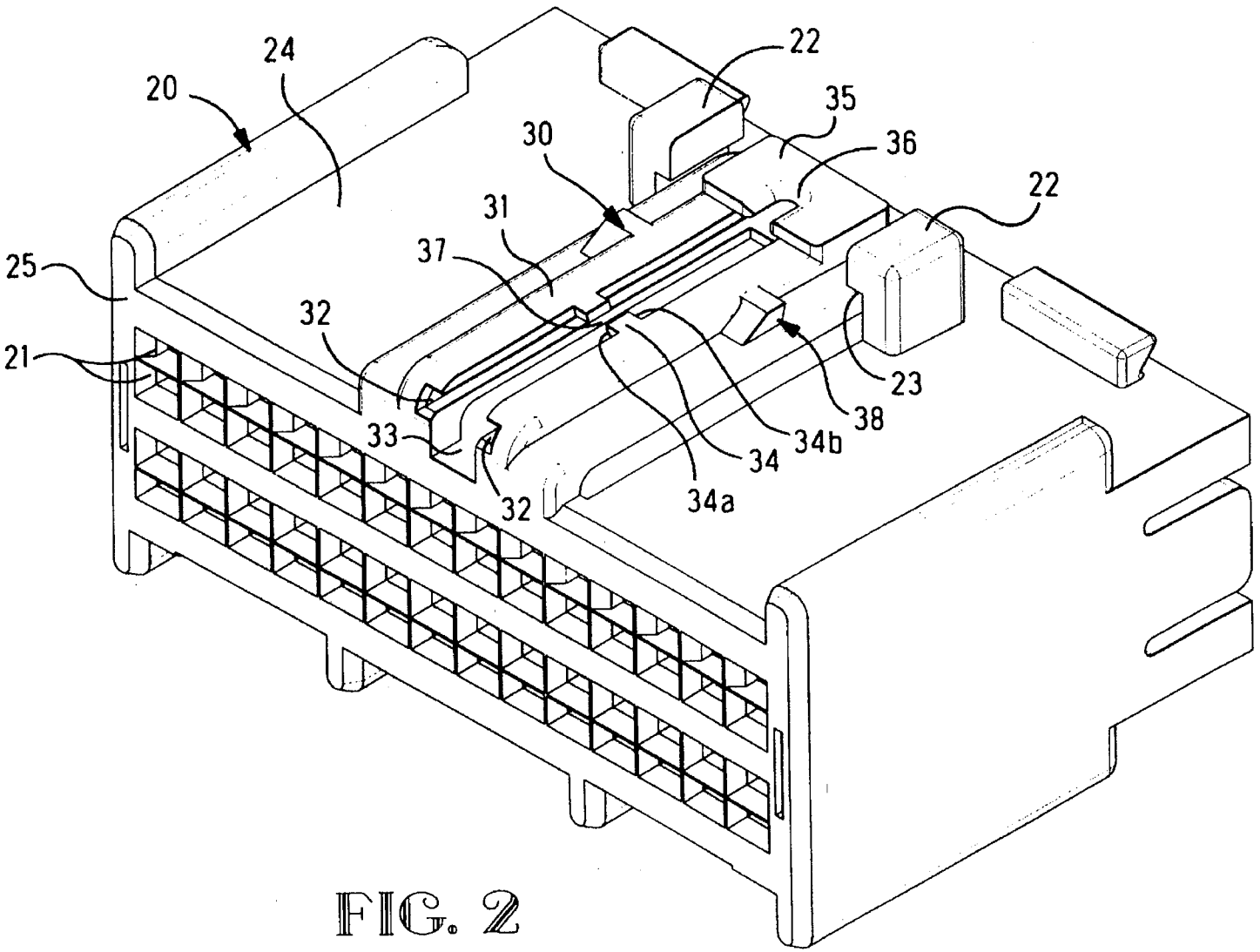
FIG. 2 shows the plug housing of FIG. 1 with the CPA removed.
Figure 3:
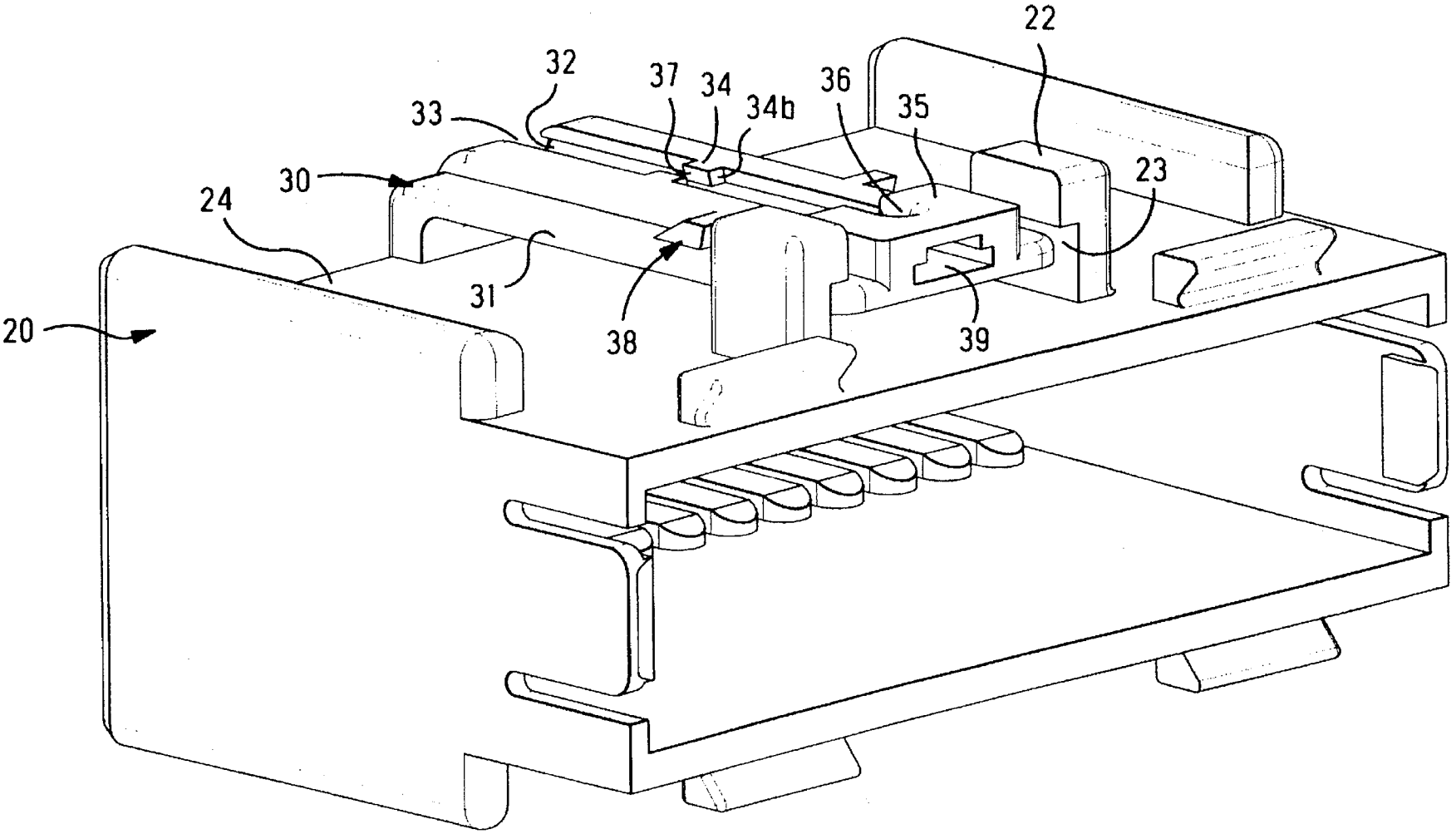
FIG. 3 shows an isometric view of the plug housing of FIG. 2 from a rear side thereof.

Now referring to FIG. 2, housing latch mechanism 30 further includes a bridge 35 which interconnects the latching arms 31, and bridge 35 includes a recess 36. Referring to FIG. 3, housing latch 30 includes a slot 39 on a rear-most side thereof for receiving flanges 42 thereat when the CPA 40 is in its first position, as will be more fully described below.

Figure 5:
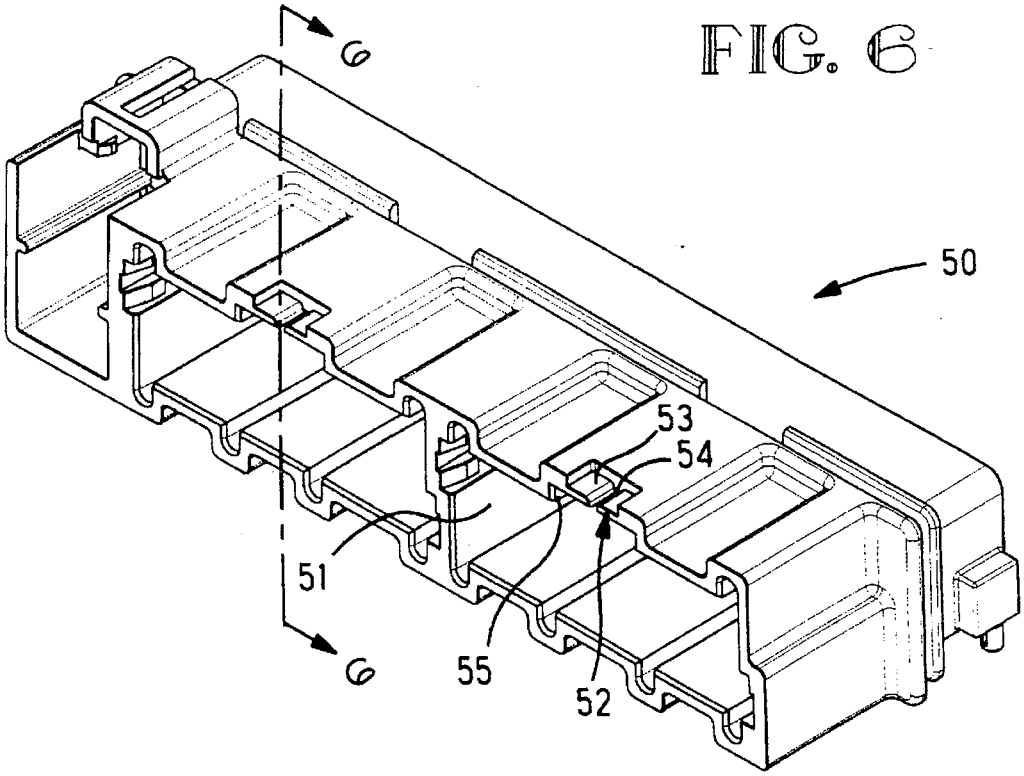
FIG. 5 shows an isometric view of a header, according to the present invention, adapted for matable connection to the plug housing of FIG. 1.

FIG. 5 shows an isometric view of a header 50 for matable connection to the plug housing 20. Header 50 includes a housing receiving aperture 51, and a CPA receptacle 52 with plates 53, a slot 54 between plates 53, and an inner space 55. Slot 54 is sized to receive support section 46 of CPA 40, and receptacle 52 is sized to receive operating section 47 of CPA 40.

Figure 6:
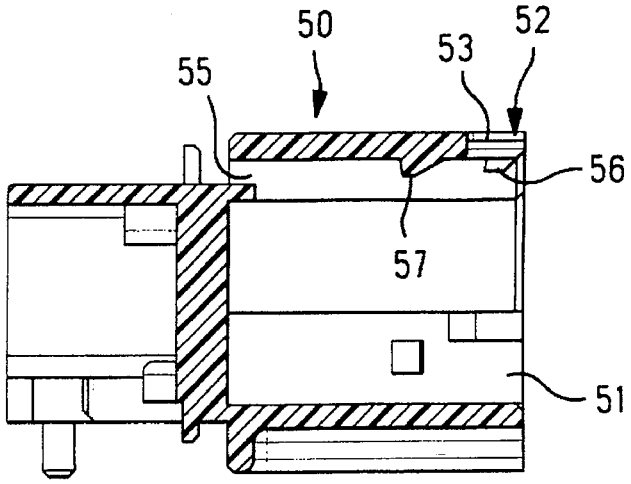
FIG. 6 shows a cross sectional view of the header of FIG. 5 taken along line 6—6.

FIG. 6 shows a cross sectional view of the header 50 of FIG. 5 taken along line 6—6. The walls of the housing receiving aperture 51 include a pair of tapered latch flanges 56 which are arranged for latching engagement with the latching shoulders 38 of deflectable beams 31 of housing latch 30. Additionally, a single tapered CPA engaging flange 57 is provided in aperture 51 for engagement with embossment 44 and embossment support 48 when the CPA is in a first position (see FIG. 11).

Figure 7:
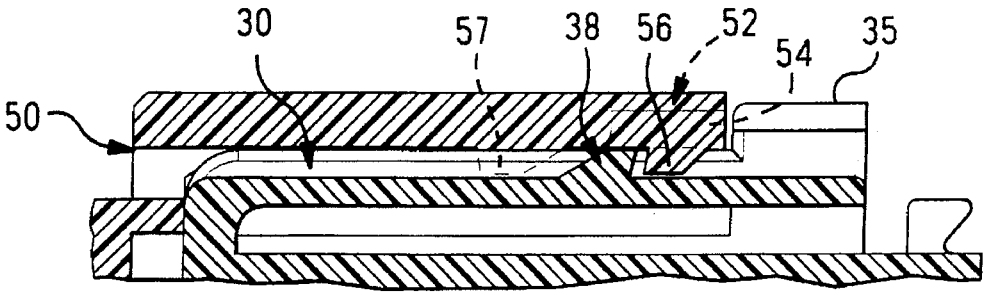
FIG. 7 shows a cross sectional view of the plug housing and header mated together without the CPA installed on the plug housing.
Figure 8:
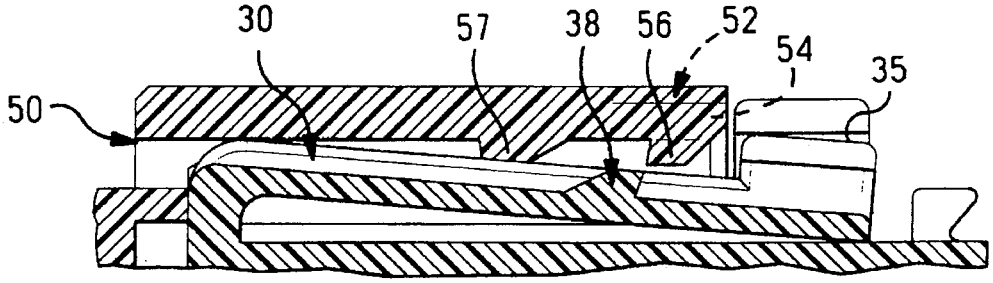
FIG. 8 shows the plug housing and header mated together but with the latch arm of the plug housing deflected downwardly.

FIG. 7 shows a cross sectional view of the plug housing 20 and header 50 mated together without the CPA 40 installed. The tapered latch flange 56 of the header 50 is set for engagement with latching shoulder 38 of the housing. FIG. 8 shows the plug housing 20 and header 50 mated together but with the latch arm 30 deflected downwardly.

Figure 9:
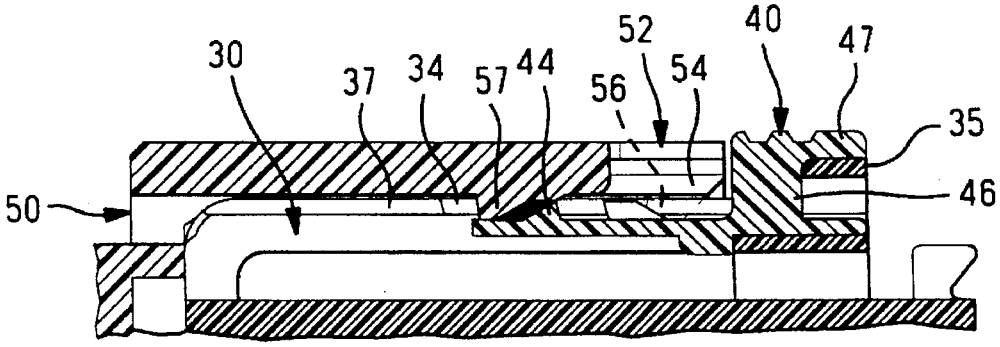
FIG. 9 shows a cross sectional view of the plug housing and header mated together with the CPA installed in a first position; however, the CPA deflectable beam is shown in an undeflected state to clearly show the interference of the beam with the CPA tapered flange on the header.

FIG. 9 shows a cross sectional view of the plug housing 20 and header 50 mated together with the CPA 40 installed; however, the CPA deflectable beam 41 is shown in an undeflected state to clearly show the interference of the beam with the CPA tapered flange 57 on the header 50. The CPA 40 is inserted into the latch arm 30 from a mating face of the plug housing 20. As shown above in FIG. 1, flanges 42 of CPA 40 are slidably received into grooves 32 and space 33 of latch arm 30. The support section 46 of CPA 40 is disposed adjacent to bridge 35 of latch arm 30, and the support section 46 is aligned for being pushed toward and received into receptacle 52 of header 50. Embossment 44 and ramp 48 are aligned for sliding engagement with tapered CPA flange 57 of header 50.

The CPA position depicted in FIG. 9 is further characterized in that: front, preferably undercut-tapered sides of the embossment 44 on CPA beam 41 are aligned for engagement with back, preferably undercut-tapered sides of stop projections 34 of housing latch 30; the support section 46 of CPA 40 is in slot 36 of housing latch 30 adjacent to bridge 35; and, the CPA 40 is thereby trapped between the stop projections 34 and bridge 35 of housing latch 30. In such a trapped position, the CPA 40 will not be subject to being accidentally dislodged from its secure position on plug housing 20 during the installation of the connector assembly while being handled on, for example, an automotive assembly line.

Figure 10:
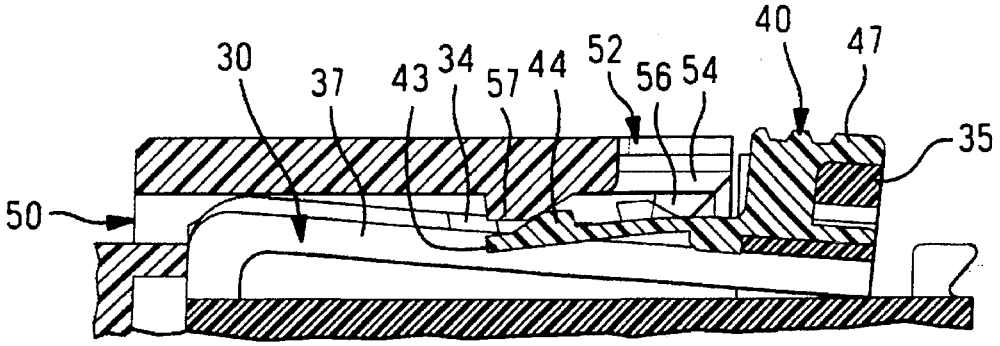
FIG. 10 shows the plug housing and header mated together but with the latch arm and CPA deflected downwardly.

FIG. 10 shows the plug housing 20 and header 50 mated together but with the latch arm 30 and CPA 40 deflected downwardly. Beam 41 will be deflected when flange 57 is in engagement with embossment 44 as shown in FIG. 11, and housing latch 30 will also be deflected to a lesser degree.

Figure 11:
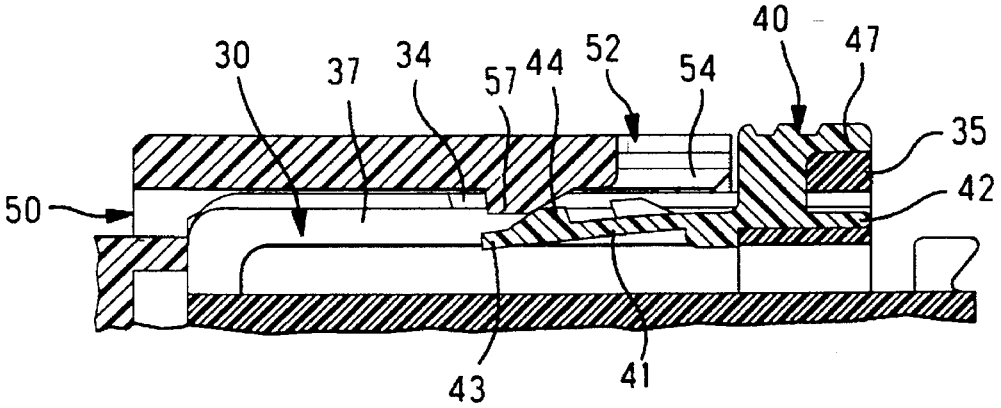
FIG. 11 shows the plug housing and header fully mated together with the CPA in the first position and deflected downwardly due to the interference of the CPA beam with the CPA tapered flange of the header.

FIG. 11 shows the plug housing 20 and header 50 mated together but with the deflectable beam 41 of CPA 40 deflected downwardly as CPA 40 is in the first position. This deflection is caused by the engagement of tapered CPA flange 57 of header 50 with ramp 48 and embossment 44, the beam 41 will bend downwardly as shown in the drawing figure. However, the flanges 42 will snugly remain in their respective positions in grooves 32 of latch arm 30 so that the flanges 42 will maintain the alignment of support and operating sections 46 and 47 of CPA 40 relative to slot 54 and receptacle 52 of header 50, respectively. Thus, end section 43 of beam 41 will be disposed at an obtuse angle relative to flanges 42 when the beam 41 is in a deflected state. Moreover, in a further advantage of the present invention, if the CPA 40 becomes loosened from the first position during shipping or handling of the plug housing 20, the operator will automatically correct this as the header 50 is engageable with the operating section 47 of the CPA 40 when the CPA is in a position as shown at FIG. 10. The header 50 will engage and push the loosened CPA 40 to the first position prior to fully mating with the plug housing 20. This is an advantage for the operator regarding ease of assembly.

Figure 12:
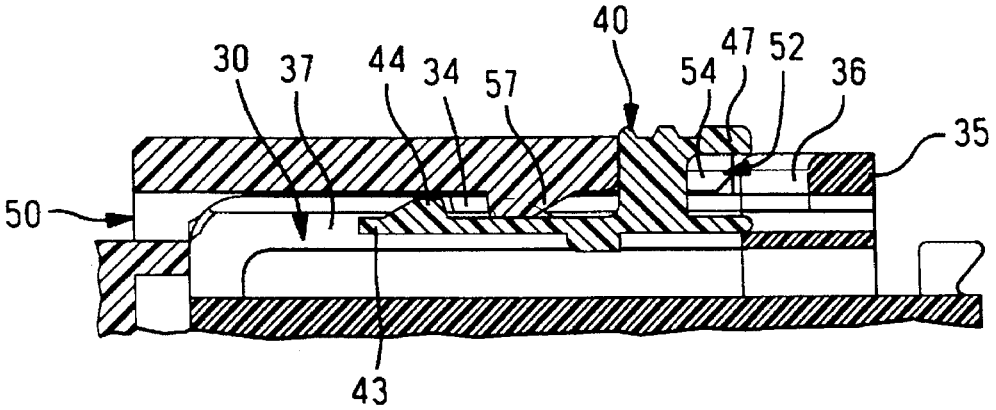
FIG. 12 shows the plug housing and header fully mated together with the CPA in its fully advanced, second position.

FIG. 12 shows the plug housing 20 and header 50 fully mated together with the CPA 40 in its fully advanced, second position. The second position is characterized in that the operating and support sections 46 and 47 have been fully advanced into slot 54 and receptacle 52, respectively. At this point in the assembly of the header 50 and plug housing 20, the operator can readily observe that the plug and header have been fully mated. Additionally, embossment 44 is securely positioned behind tapered CPA flange 57 for preventing inadvertent withdrawal of the plug housing from the header.

The second position of the CPA 40, as shown in FIG. 12, is further characterized in that: back, preferably ramp-tapered sides of embossment 44 are aligned for engagement with front, preferably ramp-tapered sides of the projections 34 of housing latch 30; and the front face of stop member 45 of CPA 40 is in abutting alignment with the back side of latch projections 34 of housing latch 30. In this second position, the CPA traps the stop projections 34 of housing latch 30 between the embossment 44 and stop member 45. Moreover, the bottom portion of operating section 47 of CPA 40 will be disposed directly over the plates 53, thereby preventing inadvertent deflection of the housing latch 30 when the CPA 40 is in the second position.

To separate the plug housing 20 from the header 50, however, the operator will push the CPA 40 away from the header 50 into the first position as shown in FIG. 11 so that the operating section 47 is clear of plates 53. The operator will then push the CPA 40 and housing latch 30 down into the position as shown in FIG. 10, and the housing 20 can then be separated from the header 50.

Thus, while a preferred embodiment of the invention has been disclosed, it is to be understood that the invention is not to be strictly limited to such an embodiment but may be otherwise variously embodied and practiced within the scope of the appended claims.

Accordingly, what is claimed is:

1. An electrical connector housing assembly which includes a connector position assurance device (CPA) and a connector housing with at least one contact receiving aperture therein which extends from a mating face of said housing, said assembly further includes:

a deflectable housing latch formed on said connector housing, said housing latch includes at least one groove formed in a deflectable beam thereof for slidably receiving a respective portion of said CPA;

said CPA respective portion comprises a flange, said CPA flange is slidably movable in said groove between first and second positions relative to said housing latch, and said CPA includes a deflectable, resilient beam;

whereby, a deflecting force which, when applied to said housing latch, causes said housing latch to deflect relative to said housing, will also cause said CPA to be displaced relative to said housing when said CPA is in said first position.

2. The assembly of claim 1, wherein said CPA deflectable beam includes an embossment and a stop member.

3. The assembly of claim 2, wherein said housing latch comprises at least one stop projection for engaging said embossment.

4. The assembly of claim 1, wherein said housing latch includes a second deflectable beam with a second groove formed therein, thereby defining a latch space between said housing latch deflectable beams.

5. The assembly of claim 4, wherein said CPA deflectable beam has a set width dimension, said latch space has a set width dimension, and said CPA beam width dimension is less than said latch space width dimension thereby permitting said CPA deflectable beam to flexibly deflect at least partially within said latch space.

6. The assembly of claim 4, wherein said CPA includes a second flange slidably disposed in said second groove, and said second flange thereby defines a flange width between said flanges.

7. The assembly of claim 6, wherein said CPA deflectable beam has a set width dimension, and said CPA beam width dimension is less than said flange width dimension, thereby permitting said CPA deflectable beam to flexibly deflect at least partially within said latch space.

8. The assembly of claim 7, wherein an obtuse angle is defined between said CPA deflectable beam and said flanges when said deflectable beam is in said first position.

9. The assembly of claim 1, wherein said housing latch includes a second deflectable beam and a bridge portion which extends between said housing latch deflectable beams, and said bridge portion has a bridge recess.

10. The assembly of claim 9, wherein said CPA includes a base portion and a generally vertically extending support section which fits into said bridge recess when said CPA is in said first position.

11. The assembly of claim 1, wherein said CPA deflectable beam resiles upwardly as said CPA moves from its first to its second position.

12. An electrical connector assembly which includes a header, a connector position assurance device (CPA), and a connector housing with at least one contact receiving aperture therein which extends from a mating face of said housing, said assembly further includes:

a deflectable housing latch formed on said connector housing, said housing latch includes at least one space formed in a beam thereof for slidably receiving a respective portion of said CPA;

said CPA is slidably movable in said space between first and second positions relative to said housing latch, said CPA includes a deflectable, resilient beam, and said first position is defined in that said portion of said deflectable beam comprises an embossment on said CPA beam which is aligned for engagement with a back side of at least one stop projection formed on said housing latch for holding said CPA in the first position; and said header includes a projection for engaging a portion of said CPA deflectable beam;

whereby, when said CPA is in said first position, said header projection engages a portion of said deflectable beam thereby deflecting the beam and thereby clearing said embossment of said stop projection and allowing said CPA to be released from said first position.

13. The assembly of claim 12, wherein when said CPA is in said first position an operating section of said CPA is adjacent to a bridge of said housing latch, which bridge extends between a pair of deflectable beams of said housing latch, and a deflecting force which, when applied to said housing latch, causes said housing latch to deflect relative to said housing, will also cause said CPA to be moved relative to said housing when said CPA is in said first position.

14. The assembly of claim 12, wherein, when said CPA is in said second position an operating section of said CPA is disposed above a pair of plates formed on said header, a support section of said CPA which supports said operating section is disposed in a gap between said plates, and said second position thereby prevents inadvertent withdrawal of said housing from said header.

15. The assembly of claim 12, wherein a CPA beam deflects into defining an obtuse, angle relative to said CPA flange when said CPA is in said first position.

16. The assembly of claim 12, wherein said CPA is trapped between said stop projection and a bridge formed on said housing latch adjacent to a support section of said CPA.

17. The assembly of claim 12, wherein said second position is characterized in that said portion of said deflectable beam comprises an embossment on said CPA beam which is aligned for engagement with a front side of at least one stop projection formed on said housing latch.

18. The assembly of claim 17, wherein said CPA is trapped between said stop projection and a stop member formed on said CPA adjacent to a support section of said CPA.

19. The assembly of claim 17, wherein said CPA second position is further characterized by alignment of an operating section of said CPA with at least one plate formed on said header.

20. An electrical connector assembly which includes a first housing, a connector position assurance device (CPA), and a connector housing with at least one contact receiving aperture therein which extends from a mating face of said connector housing, said assembly further includes:

a housing latch formed on said connector housing, said housing latch includes a space formed in a beam thereof for slidably receiving a respective portion of said CPA;

said CPA respective portion is slidably movable in said space between operating positions relative to said housing latch; whereby, when said connector housing is mated to said first housing, said first housing is engageable with an operating section of said CPA to thereby push said CPA toward an operating position adjacent a wire exit face of said housing.

21. An electrical connector assembly which includes a header, a connector position assurance device (CPA), and a connector housing with at least one contact receiving aperture therein which extends from a mating face of said housing, said assembly further includes:

a deflectable housing latch formed on said connector housing, said housing latch includes at least one space formed in a beam thereof for slidably receiving a respective portion of said CPA;

said CPA is slidably movable in said space between first and second positions relative to said housing latch, and said CPA includes a deflectable, resilient beam;

said header includes a projection for engaging a portion of said CPA deflectable beam;

whereby, when said CPA is in said first position, said header projection engages a portion of said deflectable beam thereby deflecting the beam; and when said CPA is in said second position an operating section of said CPA is disposed above a pair of plates formed on said header, a support section of said CPA which supports said operating section is disposed in a gap between said plates, and said second position thereby prevents inadvertent withdrawal of said housing from said header.

22. An electrical connector assembly which includes a header, a connector position assurance device (CPA), and a connector housing with at least one contact receiving aperture therein which extends from a mating face of said housing, said assembly further includes:

a deflectable housing latch formed on said connector housing, said housing latch includes at least one space formed in a beam thereof for slidably receiving a respective portion of said CPA;

said CPA is slidably movable in said space between first and second positions relative to said housing latch, and said CPA includes a deflectable, resilient beam;

said header includes a projection for engaging a portion of said CPA deflectable beam;

whereby, when said CPA is in said first position, said header projection engages a portion of said deflectable beam thereby deflecting the beam;

said second position is defined in that said portion of said deflectable beam comprises an embossment on said CPA beam which is aligned for engagement with a front side of at least one stop projection formed on said housing latch; and wherein said CPA is trapped between said stop projection and a stop member formed on said CPA adjacent to a support section of said CPA.

23. An electrical connector assembly which includes a header, a connector position assurance device (CPA), and a connector housing with at least one contact receiving aperture therein which extends from a mating face of said housing, said assembly further includes:

a deflectable housing beam formed on said connector housing, said housing beam includes a space formed therein which space slidably receives a respective portion of said CPA;

said CPA respective portion is slidably movable in said space relative to said beam; whereby, as said connector housing is mated to said header, a portion of said header is engageable with said CPA to thereby push and slidably displace said CPA respective portion relative to said beam.

24. The assembly of claim 23, wherein said housing comprises a mating face and a wire exit face, and said CPA displacement is generally directed from said mating face toward said wire exit face.

25. The assembly of claim 23, when the header and housing are in the fully mated position with respect to each other, and said CPA is in a fully advanced position, a force tending to deflect said beam will create mechanical stress in a support section of said CPA as said support section resists deflection of said beam.

26. An electrical connector housing assembly with at least one contact receiving aperture therein which extends from a mating face of said housing toward a wire exit face of said housing, and a CPA associated with said housing, said assembly includes:

a deflectable housing beam connected to said connector housing by attaching sections, said housing beam includes a space formed therein, which space slidably receives a respective portion of said CPA so that said CPA respective portion is slidably movable within said space relative to said beam during motion of said CPA between operating positions of said CPA; and said CPA comprises a CPA beam which is deflectable, said space comprises a space width, and said CPA beam is deflectable within said width as said CPA is moved in said space between said operating positions.

27. The assembly of claim 26, wherein said space is spanned by a bridge of said beam, said bridge is located toward an end thereof adjacent the wire exit face.

28. The assembly of claim 26, wherein said space comprises a groove for slidably receiving said CPA respective portion.

29. The assembly of claim 26, wherein said beam includes at least one blocking interface member for blocking movement of said CPA.

30. The assembly of claim 29, wherein said CPA includes at least one member formed thereon for cooperating with said blocking interface member of said beam for preventing movement of said CPA.

31. The assembly of claim 26, said CPA includes an operating section so that a directed pushing force applied to said CPA operating section is operable to deflect said beam.

32. The assembly of claim 26, wherein said CPA includes an operating section which covers a portion of said beam.

33. The assembly of claim 26, wherein said CPA engages only portions of said beam when it is operative therein.

34. The assembly of claim 26, wherein said CPA comprises a flange section disposed in said space which resists deflection as said CPA beam is deflected.

35. The assembly of claim 30, wherein said CPA comprises an embossment.

36. The assembly of claim 30, wherein said CPA comprises a stop member.

37. The assembly of claim 26, wherein said CPA comprises an embossment and a stop member, said embossment and said stop member are operative to trap a portion of said beam therebetween for inhibiting motion of said CPA relative to said beam.

38. The assembly of claim 26, wherein said beam comprises a portion which projects into said space adjacent a bridge formed on said beam, said bridge comprises a recess formed therein.

39. The assembly of claim 38, wherein said recess is located between sections of said CPA.

40. The assembly of claim 39, wherein said CPA sections comprise flange and operating sections of said CPA.

41. The assembly of claim 38, wherein at least a portion of a support section of said CPA passes through said recess.

42. An electrical connector housing assembly with at least one contact receiving aperture therein which extends from a mating face of said housing toward a wire exit face of said housing, and a CPA associated with said housing, said assembly includes:

a deflectable housing beam connected to said connector housing;

said housing beam includes a space formed therein, which space is open towards said mating face of said housing and slidably receives a respective portion of said CPA so that said CPA respective portion is slidably movable within said space relative to said beam during assembly of said CPA onto said beam.

43. The assembly of claim 42, wherein said space is spanned by a bridge of said beam, said bridge is located toward an end thereof adjacent the wire exit face.

44. The assembly of claim 42, wherein said space comprises a groove for slidably receiving said CPA respective portion.

45. The assembly of claim 42, wherein said beam includes at least one blocking interface member for blocking movement of said CPA.

46. The assembly of claim 45, wherein said CPA includes at least one member formed thereon for cooperating with said blocking interface member of said beam for preventing movement of said CPA.

47. The assembly of claim 42, said CPA includes an operating section so that a directed pushing force applied to said CPA operating section is operable to deflect said beam.

48. The assembly of claim 42, wherein said CPA includes an operating section which covers a portion of said beam.

49. The assembly of claim 42, wherein said CPA engages only portions of said beam when it is operative therein.

50. The assembly of claim 42, wherein said CPA comprises a CPA beam which is deflectable, said space comprises a space width, and said CPA beam is deflectable within said width.

51. The assembly of claim 50, wherein said CPA comprises a flange section disposed in said space which resists deflection as said CPA beam is deflected.

52. The assembly of claim 46, wherein said member CPA comprises an embossment.

53. The assembly of claim 46, wherein said member CPA comprises a stop member.

54. The assembly of claim 42, wherein said member CPA comprises an embossment and a stop member, said embossment and said stop member are operative to trap a portion of said beam therebetween for inhibiting motion of said CPA relative to said beam.

55. The assembly of claim 42, wherein said beam comprises a portion which projects into said space adjacent a bridge formed on said beam, said bridge comprises a recess formed therein.

56. The assembly of claim 55, wherein said recess is located between sections of said CPA.

57. The assembly of claim 56, wherein said CPA sections comprise flange and operating sections of said CPA.

58. The assembly of claim 55, wherein at least a portion of a support section of said CPA passes through said recess.

59. An electrical connector housing assembly with at least one contact receiving aperture therein which extends from a mating face of said housing toward a wire exit face of said housing, said housing comprising:

a deflectable housing beam connected to said connector housing;

said housing beam includes a space formed therein, which space comprises an opening towards said mating face of said housing for slidably receiving a respective portion of a CPA so that said CPA respective portion is slidably movable within said space relative to said beam during assembly of said CPA onto said beam.

60. The assembly of claim 59, wherein said space is spanned by a bridge of said beam, said bridge is located toward an end thereof adjacent the wire exit face.

61. The assembly of claim 59, wherein said space comprises a groove for slidably receiving said CPA respective portion.

62. The assembly of claim 59, wherein said beam includes at least one blocking interface member for blocking movement of said CPA.

63. The assembly of claim 59, wherein said beam comprises a portion which projects into said space adjacent said bridge, said space thereby comprising a recess.

64. An electrical connector assembly comprising first and second connector housings, said assembly further comprising:

a deflectable housing beam associated with said first connector housing, said beam comprises a CPA slidably connected thereto, and said CPA comprises an operating section aligned to be received by said second connector housing;

said second connector housing comprises a CPA receiving section, whereby when said CPA is located at an advanced position said CPA receiving section receives said CPA operating section thereover, and said CPA receiving section thereby blocks movement of said CPA operating section and inhibits deflection of said deflectable beam.

65. The assembly of claim 64, wherein said second connector housing CPA receiving section comprises a recess which receives a portion of said CPA operating section therein.

66. An electrical connector assembly comprising:

a deflectable housing beam associated with a first connector housing, said beam comprises a CPA slidably associated therewith for movement between operating positions, said CPA comprises first and second opposed surfaces defining a trap section therebewteen, said trap section receives a stopping portion of said deflectable beam thereby inhibiting movement of said CPA; and said assembly comprises a second connector housing matable with said first connector housing, said second connector housing comprises a CPA cooperating section which is operative to displace said trap section away from said stopping portion thereby allowing movement of said CPA.

67. An electrical connector assembly comprising:

a deflectable housing beam associated with a first connector housing, said beam comprises a CPA slidably associated therewith for movement between operating positions, said CPA comprises first and second opposed surfaces, said opposed surfaces comprise an embossment and a stop member formed on said CPA defining a trap section therebewteen, and said trap section receives a stopping portion of said deflectable beam thereby inhibiting movement of said CPA.

* * * * *